United States Patent [19]

Hsiao

[11] Patent Number: 4,821,547

[45] Date of Patent: Apr. 18, 1989

[54] WHEEL-DRIVING STRAIGHTENER FOR STRAIGHTENING LONGITUDINAL CYLINDRICAL MEMBER

[76] Inventor: Suei-Tien Hsiao, P.O. Box 10160, Taipei, Taiwan

[21] Appl. No.: 138,967

[22] Filed: Dec. 29, 1987

[51] Int. Cl.[4] ..... B21D 3/00

[52] U.S. Cl. ..... 72/93; 72/92; 384/626; 140/147; 29/125

[58] Field of Search ..... 72/91–94, 72/160, 462, 180; 140/147; 384/626; 16/19, 47, 248, DIG. 39; 29/125, 130

[56] References Cited

U.S. PATENT DOCUMENTS

| | | | |
|---|---|---|---|
| 851,451 | 4/1907 | Steiber | 72/180 |
| 865,908 | 9/1907 | Johnson | 72/180 |
| 3,044,528 | 7/1962 | Wullenwaber et al. | 72/91 |
| 3,045,739 | 7/1962 | Fyfe et al. | 72/92 |
| 4,269,055 | 5/1981 | Sivachenko et al. | 29/125 |
| 4,475,371 | 10/1984 | Matej | 72/92 |

FOREIGN PATENT DOCUMENTS

| | | | |
|---|---|---|---|
| 29036 | 9/1973 | Japan | 72/92 |
| 38731 | 2/1986 | Japan | 72/92 |

*Primary Examiner*—Robert L. Spruill

[57] ABSTRACT

A straightener for straightening longitudinal cylindrical bars includes: a machine body, a driving wheel unit having plural driving wheels rotatably mounted on one side of the machine body, an idle plate assembly having plural idle plates retained on the opposite side of the machine body interlacedly facing the plural driving wheels, and a driving motor for driving the driving wheels, so that upon a transverse feeding of a deformed bar into a slit defined by the driving wheels and the idle plates and rotating the wheels as driven by the motor, the bar can be arcuately moved downwardly through the arcuate slit and rotatively bitten by the wheels and the idle plates to straighten the bar.

1 Claim, 3 Drawing Sheets

WHEEL-DRIVING STRAIGHTENER FOR STRAIGHTENING LONGITUDINAL CYLINDRICAL MEMBER

BACKGROUND OF THE INVENTION

A rotary type straightener may be used to straighten a cold-drawn annealed tube and consists of rolls set with axes oblique with the pass line. These rolls are somewhat smaller in the center than at the ends to afford a line contact with the tube, which passes between the two driven rolls on one side and the three idle rolls on the other. The tube is helically advanced by the rolls which are adjusted to bend the tube progressively as it moves through the machine. Since the tube to be straightened is advanced by the oblique rolls, the tube must preclude any extension transversely formed on the tube. Therefore, a bolt with screw head can not be straightened by such a conventional rotary type straightener.

The present invention has found the drawback of a conventional rotary type straightener and invented the present wheel-driving straightener, especially suitable for straightening a screw bolt.

SUMMARY OF THE INVENTION

The oject of the present invention is to provide a straightener including: a machine body, a driving wheel unit having plural driving wheels rotatably mounted on one side of the machine body, an idle plate assembly having plural idle plates retained on the other side of the machine body interlacedly facing the plural driving wheels and a driving motor driving the wheels, whereby upon the feeding of a deformed screw bolt, after a heat treatment such a quenching process, into an arcuate slit operatively defined between the driving wheels and the idle plates, the bolt will be straightened effectively as rotatably bitten between the rotating driving wheels and the idle plates.

DETAILED DESCRIPTION

Figure 1:
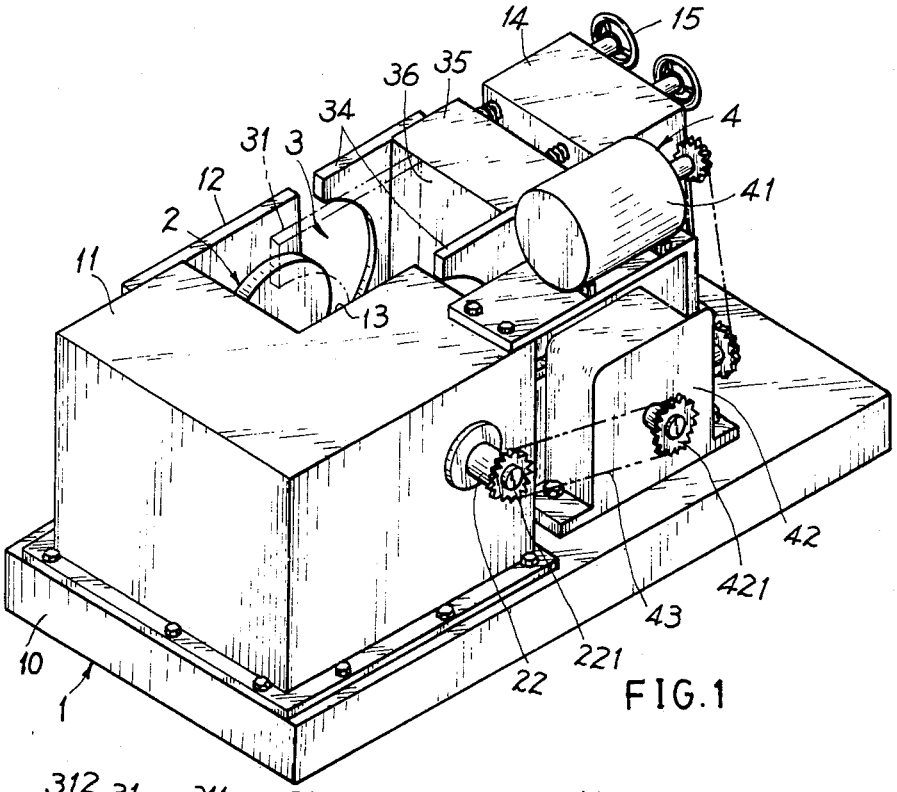
FIG. 1 is a perspective illustration of the present invention.

As shown in the figures, the present invention comprises: a machine body 1, a driving wheel unit 2, an idle plate assembly 3 and a driving motor means 4.

The machine body 1 includes: a base portion 10, a left frame 11 having two side brackets 12, 13 for rotatably mounting the driving wheel unit 2, and a right frame 4 having plural adjusting bolts 15 formed therein for adjusting the idle plate assembly 3 adjustably mounted on the base portion 10 of the body 1. Each bolt 15 is formed male-threaded portion 151 to engage with a female-threaded hole 141 in frame 14.

The driving motor means 4 includes: a driving motor 41 mounted on the machine body 1, a gear box 42 for reducing the rotation speed of the motor having an output gear 421, and a transmission chain 43 coupling the motor gear 421 to an input gear 221 of a driving shaft.

The driving wheel unit 2 includes: plural annular wheel members 21 mounted on a driving shaft 22, plural wheel-space adjusting means 23 each partitioning every two neighboring wheel members 21, and two retaining disks 24 secured on two opposite end portions of the shaft 22 to limit the wheel members 21 and the space adjusting means 23 therebetween.

Each annular wheel member 21 is formed with three axially extending grooves on its inner periphery to engage with triple longitudinal extensions 220 radially formed on the shaft 22 to thereby slidingly mount the wheel member 21 on the shaft 22.

Each wheel-space adjusting means 23 includes: an inner annular disk 231 having three axially extending grooves 232 on its inner periphery of the disk 231 to slidingly engage with the triple extensions 220 of shaft 22 and having three notches 233 radially formed on a periphery of the disk 231, three spacing bars 234 each having a central ring groove 235 circumferentially formed on each bar around a longitudinal axis of the bar and each bar 234 snugly mounted in each notch 233 on the disk 231, and a fastening collar 236 having an opening **236*a* formed on the collar 236 slightly larger than a diameter of each bar 234 disposing around and securing the bars 234 with the disk 231 by fixing a screw 239 through the collar into a scrw hole 231a formed on the disk 231**.

The collar 236 is provided three holes 237 therethrough, each hole being inserted with a steel ball 238 which is retained by a spring **238*a* and a threaded plug 238*b* in the collar 236 to rotatively engage each ball 238 with each ring groove 235 formed on each bar 234 so that the collar 236 can be rotated to deviate the collar opening 236*a* from the bar 234 to fix the bar on the disk 231 and can be rotated to coincide the opening 236*a* with the bar 234 so that a bar can be taken out through the opening 236*a* for replacing with another bar of different length, for adjusting the space between every two wheel members 21** corresponding to the processing article B to be straightened by this invention.

The idle plate assembly 3 includes: plural idle plates 31 each plate 31 formed as generally rectangular shape having a semicircular recess 311 formed on a central portion of each plate 31, and plural plate-space adjusting means 32 each positioned between every two neighboring plates 31 and each backing on a vertical surface 36 and standing on a bottom plate 37 of a L-shaped block 35 adjustably mounted on a base portion 10 of the machine body 1. The plural plates 31 are retained between two side plates 34 formed on the block 35 as clamped by plural fastening bolts 33 adjustably mounted on the side plate 34. The bottom plate 37 of block 35 is formed with several longitudinal slits 371 and several screws 372 are each provided through each slit 371 to adjust the frontward or rearward position of the block 35 and the plates 31 mounted thereon on shown in FIG. 2.

Figure 2:
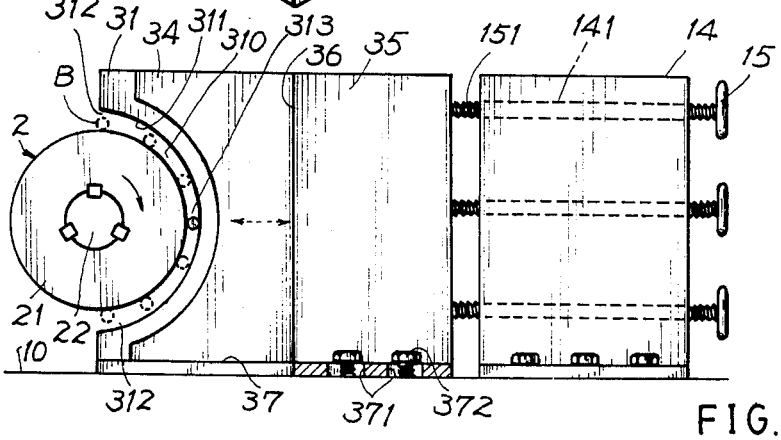
FIG. 2 is a side-view illustration of the present invention.
Figure 3:
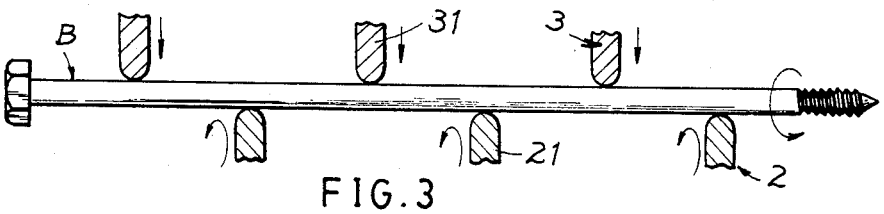
FIG. 3 is an illustration showing a bolt operatively straigtened between the driving wheels and the idle plates in accordance with the present invention.
Figure 4:
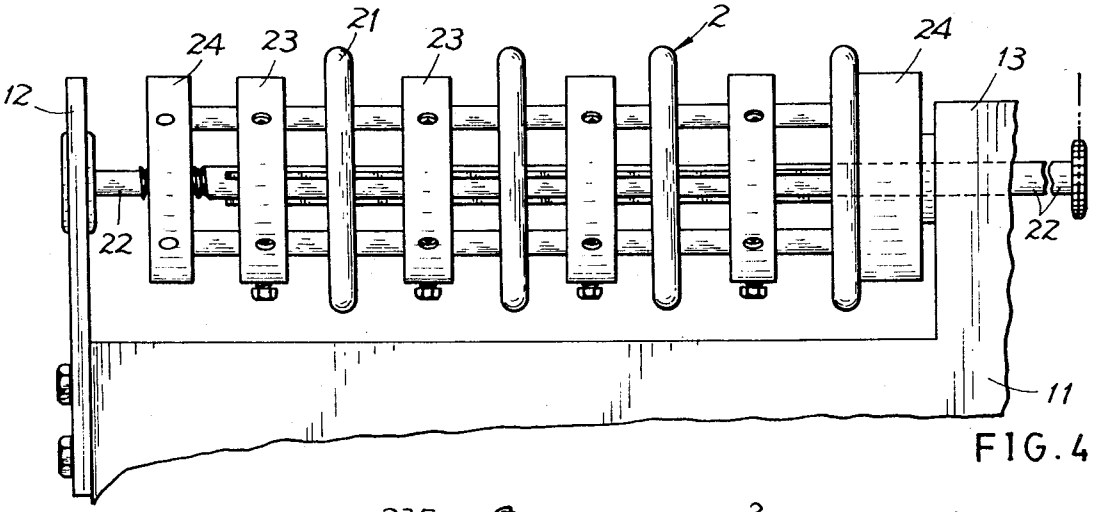
FIG. 4 is a top-view illustration of the driving wheel unit of the present invention.
Figure 5:
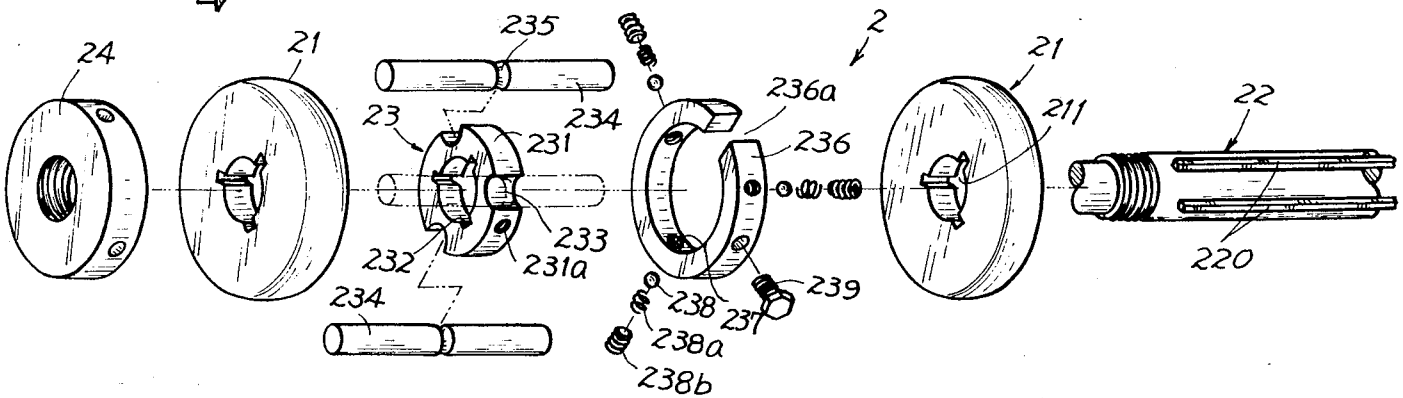
FIG. 5 is an illustration partially showing the elements of the driving wheel unit of the present invention.
Figure 6:
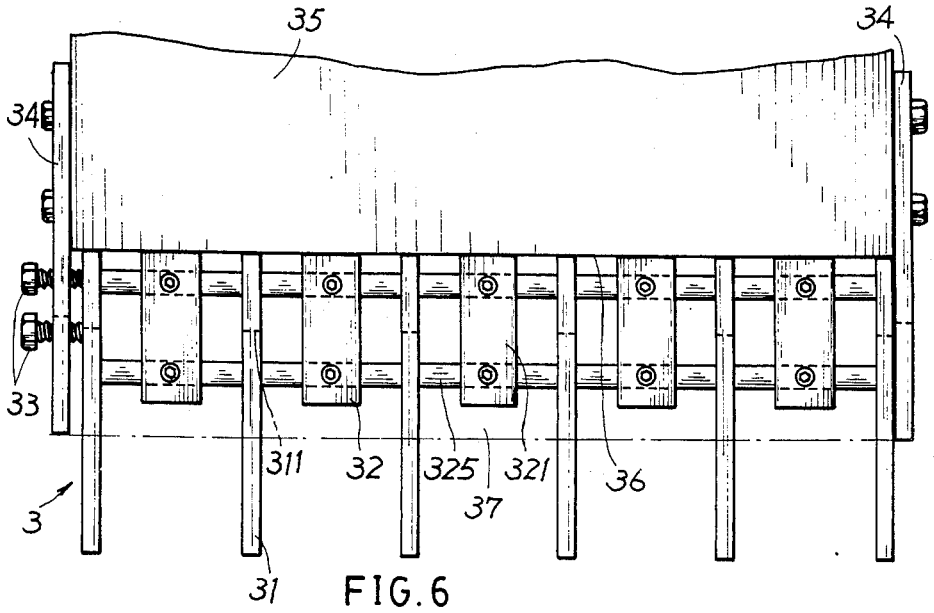
FIG. 6 is a top-view illustration of the idle plate assembly of the present invention.
Figure 7:
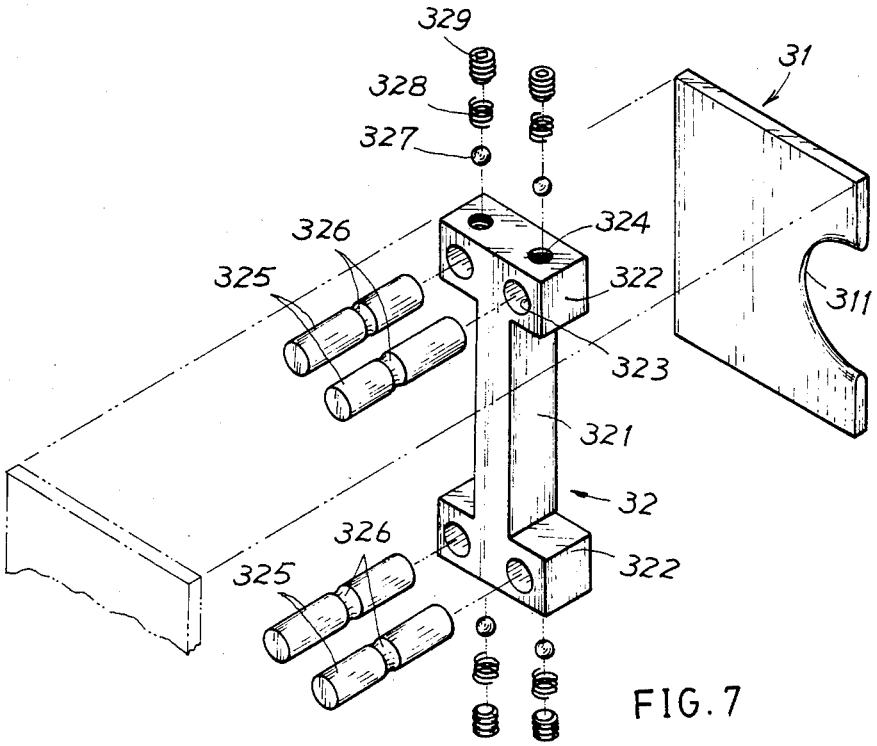
FIG. 7 is a partial perspective illustration showing the elements of the idle plate assembly of the present invention.

The idle plates 31 are juxtaposedly retained on the block 35 on the base portion 10 in front of the right frame 14 to be axially offset from and facing the plural wheel members 21 as juxtaposedly mounted on the shaft 22 rotatably mounted on the side brackets 12, 13 of the left frame 11 on the base portion 10 as shown in FIG. 3 and 2. The semi-circular recess 311 of the idle plate 31 has a diameter slightly larger than a diameter of the wheel member 2. An arcuate slit 30 having a space slightly larger than a diameter of a bolt B to be processed is operatively defined between the wheel member 21 and the recess 311, which includes two enlarged ports 312 gradually diverged from a central tightening slit portion 313 having a space equal or slightly smaller than the diameter of the straightened bolt B positioned at the central point of the recess 311, as shown in FIG. 2.

The plate-space adjusting means 32 includes: an I-shaped plate 321 having two horizontal levers 322 respectively formed on an upper and a bottom portion of the plate 321, each lever 322 formed two horizontal holes 323 and two vertical screw holes 324 in the lever 322; and four spacing bars 325 each formed a central ring groove 326 thereon respectively inserted in the horizontal holes 323 formed on the upper and bottom levers 322. Each bar 325 is inserted into each horizontal hole 323 and is retained therein by engaging a steel ball 327 as held in the vertical hole 324 as restored by a spring 328 limited by a threaded plug 329 fixed in the hole 324. When it is intended to adjust the space between the neighboring plates 31 corresponding to a bolt length to be straightened, the spacing bars 325 can be withdrawn from the holes 323 when loosening the threaded plug 329.

When using the present invention for straightening a cylindrical member such as: a bolt, a bar or the like, a deformed bolt B is transversely fed into the upper enlarged port 312 as shown in FIG. 2 and the motor is running to rotate the wheel members 21 clockwise to operatively force the bolt B being processed to cause the bolt to rotate counterclockwise and arcuately moving downwardly along each recess 311 of the idle plate 31. By moving the bolt from upper enlarged port 312 through middle tightening slit portion 313 to the lower enlarged port 312 of the arcuate slit 310 as defined between the wheels 21 and the idle plates 31, the deformed bolt B will be straightened by mutual bending and straightening operation as effected by the driving wheel set 2 and the corresponding idle plate set 3.

For processing bolts of different diameters, the adjusting bolts 15 can be operated to move the idle plates 3 either frontwardly or rearwardly in commensuration with the driving wheels 2. For suiting bolts of different length, the spacing bars 234 or 325 of the driving wheel unit 2 or the idle plate assembly can be replaced or changed for optimum processing therefor. For instance, a shorter bolt can be straightened by selecting a narrow spacing between every two wheels 21 or idle plates 31.

Accordingly, the present invention has the following advantages superior to a conventional rotary type straightener:

1. The bolt or cylindrical rod can be transversely fed into the slit between the wheels 21 and the idle plates 31 and circulatively straightened downwardly, other than a horizontal advancing operation, so that any bolt or rod having screw head or extending portion formed thereon can be straightened since the extending portion can be put into the space between the neighboring wheels 21 or plates 31 and will not be rolled or squeezed during the processing.

2. Straightening operation is performed in a circular motion to thereby save the operation space and construction cost, without building a longer straightening line as found in a conventional rotary straightener.

3. For adjusting the space between the neighboring wheels 21, it is simply done by rotating the collar 236 to coincide the opening **236*a* with the spacing bar 234 for easier replacing operation without overall dismantling the shaft 22, the wheels 21 and the adjusting means 23**.

I claim:

1. A wheel-driving straightener for straightening longitudinal cylindrical member comprising:

a machine body having a base portion, a left frame having two side brackets formed on a left portion on said base portion, and a right frame having plural adjusting bolts formed through said right frame formed on a right portion on said base portion;

a driving wheel unit having a plurality of annular wheel members juxtaposedly mounted on a driving shaft rotatably mounted on said two side brackets of said left frame, and having plural wheel-space adjusting means mounted on said driving shaft each wheel-space adjusting means partitioned between every two neighboring wheel members, said driving shaft driven by a driving motor means mounted on said machine body; and an idle plate assembly having a plurality of idle plates each idle plate having a semi-circular recess formed on a front portion of said idle plate generally shaped as rectangular, said idle plates juxtaposedly retained on a block adjustably mounted on said base portion and adjusted toward and away from said driving wheel unit by said adjusting bolts formed on said right frame, said idle plates being axially offset from and facing said plural wheel members and operatively defining an arcuate slit between the driving wheel unit and the idle plate assembly for the transverse insertion of a cylindrical member to be straigtened into said arcuate slit, every two said idle plates partitioned by a plate-space adjusting means and fastened on said block for retaining said idle plates in said block, whereby upon the rotation of the wheel members as driven by said driving motor means, a cylindrical member being straightened is operatively bitten between the wheel members and the idle plates and arcuately moving downwardly for its straightening;

said plurality of annular wheel members being formed with three axially extending grooves on the inner periphery thereof engageable with triple longitudinal extensions radially formed on said driving shaft;

the improvement which comprises:

said wheel-space adjusting means including an inner annular disk having three axially extending grooves on its inner periphery slidingly engaged with the triple extensions in said driving shaft, plural spacing bars mounted on plural notches circumferentially formed on the inner disk, and a fastening collar securing said spacing bars on said inner disk and having a radially extending opening larger than a diameter of the spacing bars for selectively coinciding with said bars for replacement with other bars of different length through said collar opening.

* * * * *